US006938674B2

(12) United States Patent
Eriksson

(10) Patent No.: US 6,938,674 B2
(45) Date of Patent: Sep. 6, 2005

(54) DEVICE AND A METHOD FOR CONTINUOUS CASTING

(75) Inventor: Jan-Erik Eriksson, Västerås (SE)

(73) Assignee: ABB AB, Väterås (SE)

( * ) Notice: Subject to any disclaimer, the term of this patent is extended or adjusted under 35 U.S.C. 154(b) by 0 days.

(21) Appl. No.: 10/491,111

(22) PCT Filed: Sep. 27, 2002

(86) PCT No.: PCT/SE02/01756

§ 371 (c)(1),
(2), (4) Date: Oct. 18, 2004

(87) PCT Pub. No.: WO03/041893

PCT Pub. Date: May 22, 2003

(65) Prior Publication Data

US 2005/0039876 A1 Feb. 24, 2005

(30) Foreign Application Priority Data

Sep. 27, 2001 (SE) ..... 0103205

(51) Int. Cl.[7] ..... B22D 11/00; B22D 27/02
(52) U.S. Cl. ..... 164/466; 164/502
(58) Field of Search ..... 164/466, 468, 164/502, 504

(56) References Cited

U.S. PATENT DOCUMENTS 5,197,535 A 3/1993 Mulcahy

FOREIGN PATENT DOCUMENTS

| | | |
|---|---|---|
| JP | 63104758 | 5/1988 |
| JP | 01271035 | 10/1989 |
| JP | 5-154620 | * 6/1993 |
| JP | 2000158108 | 6/2000 |
| WO | WO9911403 | 3/1999 |

* cited by examiner

*Primary Examiner*—Kuang Y. Lin
(74) *Attorney, Agent, or Firm*—Venable LLP; Eric J. Franklin

(57) ABSTRACT

An apparatus for continuous casting of metals has members (16) adapted to generate a stationary magnetic field of a variable strength over substantially the entire horizontal cross section of the mould from one long side to the other long side close to, or below, the region for supply of molten metal at a distance below the upper surface of the molten metal. There are also members (17) adapted to generate a variable magnetic field in the area of the upper surface in a region that is centrally located with respect to said cross section and close to a region for supply of molten metal. A unit (12) is adapted to control said magnetic members (16, 17) to generate, independently of each other, magnetic fields with an appearance that is dependent on the value prevailing of one or more predetermined casting parameters.

37 Claims, 4 Drawing Sheets

DEVICE AND A METHOD FOR CONTINUOUS CASTING

FIELD OF THE INVENTION AND BACKGROUND ART

The present invention relates to a method and an apparatus for continuous casting of metals, comprising a casting mould with an elongated horizontal cross section, through which a molten metal is intended to pass during the casting operation, a member for supplying a molten metal to such molten metal already present in the casting mould in a region at a distance below the upper surface of the latter melt, and a device adapted to apply magnetic fields to the melt in the casting mould to influence movements of the molten material.

An apparatus of the above-mentioned type is illustrated schematically in the accompanying FIG. 1. From a so-called tundish 1, a molten metal 2 is supplied to a casting mould 3 in the form of a box, open at the top and at the bottom, having cooled walls, usually of a copper-based alloy with a good thermal conductivity. The cooling in the casting mould causes the solidification of the elongated strand, formed by the molten metal, to begin from the outside and proceed inwards towards the centre of the strand. During casting with the above-mentioned cross section of the casting mould, a strand is formed which is usually referred to as a slab. The cooled and partially solidified strand continuously leaves the casting mould. At a point where the strand leaves the casting mould, it has at least one mechanically self-supporting, solidified casing 4 that surrounds a non-solidified centre 5. It is shown schematically how it is sufficient with guide rollers S to guide and support the strand downstream of the casting mould.

For the further explanation of the field of the invention, a brief reference is also made to part of FIGS. 2*a* and 2*b*, although the apparatus shown therein does not belong to the prior art but to the present invention. From the tundish 1 extends a casting pipe 6 for supplying the hot molten metal into the molten metal already present in the casting mould 3 at a distance, preferably a considerable distance, below the upper surface 7 of the latter melt, this surface being usually referred to as the meniscus. The melt flows out of the casting pipe 6 in laterally located openings therein and thereby generates a so-called primary flow as well as a so-called secondary flow. These flows are schematically indicated by the dashed arrows in FIG. 2*b*. The primary flow 8 extends downwards in the casting direction, whereas the secondary flow 9 extends from the area of the walls 10 of the casting mould upwards towards the upper surface of the molten bath and then downwards. In different parts of the molten bath that exists in the casting mould, or the mould, periodic velocity fluctuations arise in the cast material during the casting process. These fluctuations are also due to the walls of the casting mould being normally set into an oscillating movement to prevent solidified cast material from adhering thereto. The irregular movements caused thereby in the molten metal implies, inter alia, that bubbles, for example argon gas bubbles, and impurities in the melt, for example oxide inclusions from the casting pipe and slags from the meniscus, are transported far down in the casting direction, that is, far down in the cast strand that is initially formed in the casting mould. This results in inclusions and irregularities of the finished, solidified cast strand. These problems become especially great in the case of high casting speeds, that is, when a large volume of molten material is supplied to the casting mould per unit of time.

This also entails a considerable risk of irregular speeds of the movements of the molten material in the area of the upper surface of the bath and of resultant pressure variations at the upper surface, and a risk that variations in height may occur in the upper surface. At high casting speeds, this leads to slag being drawn down, uneven slag thickness, uneven shell thickness, and a risk of formation of cracks. There is also a risk of oscillations of the molten material in the casting mould leading to an unsymmetrical speed of the cast material downwards in the mould, such that the speed at one side becomes considerably higher than the speed at the other side. This results in a considerable transport downwards of inclusions and gas bubbles with an ensuing deteriorated slabs quality.

Thus, for the casting result, it is important to achieve a speed of the molten metal downwards in the casting mould that is essentially uniform over the cross section of the casting mould, that is for the primary flow, and a stable upwardly-directed flow at the short sides of the casting mould so that the movements of the molten metal in the area of the upper surface of the molten bath become constant in time and such that a uniform, stable temperature is achieved at the upper surface of the melt.

It is for this reason that a device as mentioned above (indicated at 11 in FIG. 1) is arranged to apply magnetic fields to the melt in the casting mould. In this context, a plurality of various ways of influencing the movement of the molten material by applying magnetic fields have been suggested. One way is to utilize the so-called EMBR (ElectroMagnetic BRake) technique, in which a stationary magnetic field, that is, a magnetic field generated by leading a direct current through a coil of an electromagnet, is applied to the melt in the casting mould from one long side to the other. This then results in the movements of the molten material being braked. In this context, such electromagnets may be arranged along the casting mould in the vicinity of, or below, the region for the supply of molten metal in order thus to brake the flow of the molten metal downwards in the casting mould, that is, substantially to influence the primary flow mentioned, to try to render the speed of this movement essentially constant over the whole cross section of the casting mould, and to stabilize the upwardly-directed secondary flow at the short sides of the casting mould. However, it is also possible to arrange a so-called brake in the area of the upper surface of the casting mould to brake the movements of the molten metal in this area and remove surface oscillations in the melt. These two locations of electromagnetic brakes may also be combined into a so-called FC (Flow Control) mould, which is previously known from, for example, JP 97357679.

Another way of influencing movements of the molten material in the casting mould by applying a magnetic field to the melt in the casting mould is previously known from, for example, U.S. Pat. No. 5,197,535 and is referred to as EMS (=Electromagnetic Stirring). Here, by connecting a polyphase ac voltage to electromagnets along the casting mould, a travelling magnetic field is generated, which is usually applied in the area of said upper surface to guide the movements of the molten material in this area. This is, therefore, of interest especially at lower casting speeds, since there is then a risk that the movement of the cast material in the area of the upper surface will be too small and that temperature differences, which have a negative influence on the casting result, may arise.

Also other apparatuses for influencing movements of the molten material, by applying magnetic fields to the melt in a casting mould for continuous casting, are previously known.

SUMMARY OF THE INVENTION

The object of the present invention is to provide an apparatus and a method which make it possible to obtain, at least under certain casting conditions, a casting result which, at least in certain respects, is improved in relation to what is possible to achieve with prior art apparatuses and methods for continuous casting of metals.

This object is achieved according to one aspect of the invention in that, in such an apparatus, the device exhibits members adapted to generate a stationary magnetic field with a variable strength over essentially the whole of said cross-section of the casting mould from one long side to the other long side in the vicinity of, or below, the region for said supply of the molten metal, and members adapted to generate a variable magnetic field in the area of said upper surface in a region that is centrally located with respect to said cross section and close to said region for supply of melt, and, in addition, the apparatus exhibits a unit adapted to control the magnetic members of the device to generate, independently of each other, magnetic fields with an appearance that is dependent on the value prevailing of one or more predetermined casting parameters.

By arranging the above-mentioned magnetic members at both of said locations and controlling these independently of each other and in dependence on the value prevailing of one or more predetermined casting parameters, a flow rate of the melt in various parts of the casting mould which is optimal for a uniform, stable temperature of the upper surface of the melt may to a large extent be achieved under changing casting conditions, primarily casting speed.

By "stationary" is meant here a magnetic field that is essentially fixed and does not change its direction, but its strength may vary and this also occurs in dependence on the value prevailing of one or more of said casting parameters. The term "variable magnetic field", however, comprises also magnetic fields of so-called alternating type, that is, where the magnetic field is generated by an electromagnet supplied with an alternating current. "In the vicinity of, or below," is defined as covering all levels below, at the same level as, and somewhat above the region for supply of the molten metal.

Consequently, through the apparatus according to the invention, a braking of the downward movement of the melt, adapted to the value prevailing of one or more said casting parameters, may be performed by means of the first-mentioned magnetic member, which permits the above-mentioned bubbles to rise to the upper surface and be removed and not be incorporated in the solidified portion of the strand, while at the same time the secondary flow upwards at the short ends of the strand may be stabilized for stable supply of hot melt to the meniscus and energy addition thereto. Further, the last-mentioned magnetic member adapted to generate a variable magnetic field can ensure that the movements of the melt in the area of the upper surface thereof, especially in said central region, are the most suitable movements at a value prevailing of one or more of said predetermined casting parameters, for achieving, over the whole cross section of the casting mould, an essentially uniform speed of the melt at the upper surface and hence a uniform, stable temperature of the upper surface of the melt.

According to another aspect of the invention, an apparatus of the kind defined in the introductory part of the description exhibits a device with members adapted to generate a stationary magnetic field with a variable strength in the area of said upper surface in the end regions of the casting mould which, with respect to said cross section, are located externally of and remotely from the above-mentioned region for supply of melt, and the apparatus further comprises a unit adapted to control said outer magnetic member to generate a magnetic field with a strength that is dependent on the value prevailing of one or more predetermined casting parameters.

By arranging such magnetic members, movements of the molten material in the area of said upper surface may be braked in said end regions to an extent that is optimal for the prevailing conditions on each individual casting occasion, that is, the value prevailing of one or more predetermined casting parameters. This implies that the possibilities of achieving a uniform desired movement and a uniform, stable temperature of the upper surface of the melt are improved. Especially in the case of casting speeds in an intermediate range and at higher casting speeds, it may be important to brake the movements of the molten material in the area of the upper surface in these end regions, whereas such braking may be made very slight or be completely eliminated at lower casting speeds by controlling the strength of the stationary magnetic field down towards zero.

According to a preferred embodiment of the invention, the apparatus according to the invention comprises both the magnetic members according to the first aspect of the invention and the magnetic members according to the second aspect of the invention. This then leads to possibilities of achieving a flow rate of the melt in various parts of the casting mould which is optimal for the casting result, both deeper downwards in the casting mould and upwards in the casting mould, and in the area of the upper surface, as well as a uniform, stable temperature and movement of the upper surface of the melt irrespective of the casting speeds occurring. In other words, with one and the same apparatus, an excellent casting result may be obtained at low casting speeds, when the melt in the area of the upper surface needs to be stirred, above all near the casting pipe, and be accelerated, at casting speeds in an intermediate range, when hot molten material needs to be supplied to the area of the upper surface from the casting jet, stirring in the area of the upper surface around the casting pipe is needed and the movements of the melt in the area of the upper surface must be braked somewhat to obtain a maximum flow rate in the upper surface, and at high casting speeds, when the braking of the upper surface must be strong to achieve an optimum speed of the melt in the area of the upper surface, while at the same time no stagnation zones are allowed to arise centrally around the casting pipe.

According to a preferred embodiment of the invention, said magnetic members for generating a magnetic field in said central region comprise at least two magnetic cores, arranged at each long side of the casting mould, with electric conductor windings connected to different phases of a source for generating a polyphase ac voltage for achieving a magnetic field that travels in said central region in the upper surface of the melt in a direction towards the long side of the casting mould, which makes possible stirring and acceleration of the movement of the molten material in this central region of the upper surface of the melt when this is needed.

According to another preferred embodiment of the invention, which is a further development of the latter embodiment, the apparatus comprises means for varying the frequency of the current through the windings of the magnetic member for generating the magnetic field in said central region of the casting mould, and the unit is adapted to control said means in dependence on the value prevailing of one or more predetermined casting parameters. By such a change of the frequency—which incidentally can be combined with a change of the amplitude—of the magnetic field, the molten material may in the central region be influenced into a movement which is the most optimal one for the particular casting conditions prevailing, and according to a further preferred embodiment of the invention, said means has the ability to control said frequency down to 0 Hz, which means that a direct current is then fed through the windings and a stationary magnetic field is generated in the area of the upper surface in said central region of the casting mould, such that these magnetic members then exert a braking effect on movements in this central region, which is suitable for high casting speeds. The strength of this braking effect is then controlled according to the casting speed and any other casting parameters so that an optimum movement of the molten material in this region occurs and no stagnation zones are formed in this area. Preferably, said means is a converter of a kind known per se.

According to preferred embodiments of the invention, the apparatus comprises members adapted to measure the temperature of the melt in the casting mould near said upper surface and to send information about this to the unit as a said predetermined casting parameter, members adapted to measure the casting speed, that is, how large a volume of melt that is supplied to the casting mould per unit of time, and to send information about this to the unit as a said predetermined casting parameter, and/or members adapted to measure the level of said upper surface of the melt in the casting mould and to send information about this to the unit as a said predetermined casting parameter. Since the unit takes into consideration different such casting parameters in its control of the magnetic members, in each given situation the molten material in the casting mould may be influenced to achieve an optimum casting result.

The invention also includes the case where the unit is adapted to control one or more said magnetic members occasionally not to generate any magnetic field. Thus, any of the magnetic members could be completely shut off at a value of any casting parameter, such as casting speed, within a predetermined range of values.

According to another preferred embodiment of the invention, the unit is adapted, at determined values of one or more of said predetermined casting parameters, to control said members for generating a magnetic field in the area of the upper surface in said central region to alternately generate a so-called alternating field, changing in time, for stirring the molten metal and a stationary magnetic field for braking the movements of the molten metal. In this way, under certain casting conditions, a very good temperature equalization of the melt in the area of the upper surface of the molten bath may be obtained.

From the above it is clear that the unit is advantageously adapted to control said magnetic members in dependence on the value prevailing of one or more predetermined casting parameters according to an algorithm for the purpose of achieving a flow rate of the melt in different parts of the casting mould which is optimal for the casting result, and a uniform, stable temperature of the upper surface of the melt.

The invention also relates to methods for continuous casting of metals according to the appended independent method claims. How these methods function and the advantages thereof should be manifestly clear from the above discussion of the apparatuses according to the invention.

The invention also relates to a computer program, a computer program product and a computer-readable medium according to the corresponding appended claims. It is readily realized that the method according to the invention defined in the appended set of method claims is well suited to be carried out by program instructions from a processor controllable by a computer program provided with the program steps in question. Further advantages and advantageous features of the invention will be clear from the following description and the other dependent claims.

BRIEF DESCRIPTION OF THE DRAWINGS

Preferred embodiments of the invention, cited as examples, will be described in the following with reference to the accompanying drawings, wherein.

DETAILED DESCRIPTION OF PREFERRED EMBODIMENTS OF THE INVENTION

Figure 1:
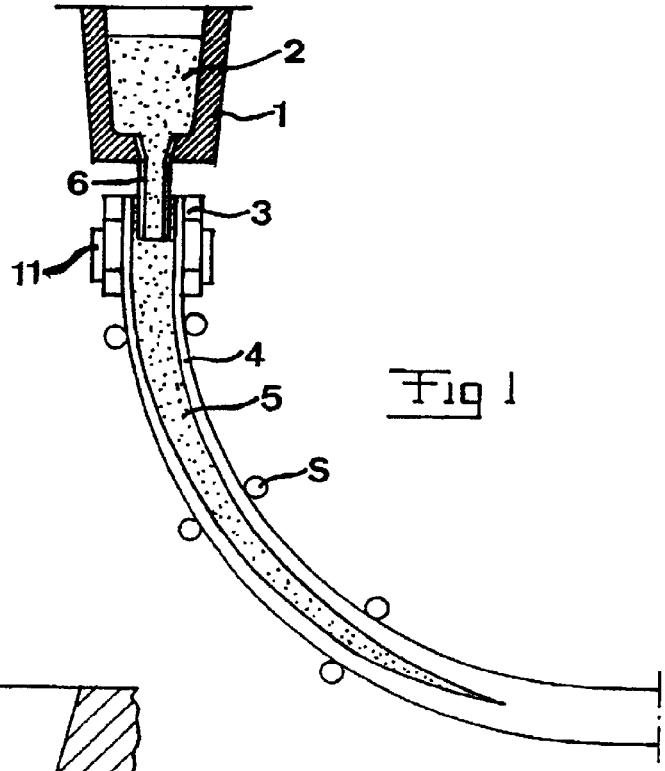
FIG. 1 is a schematic cross-section view of an apparatus for continuous casting of metals.
Figure 2A:
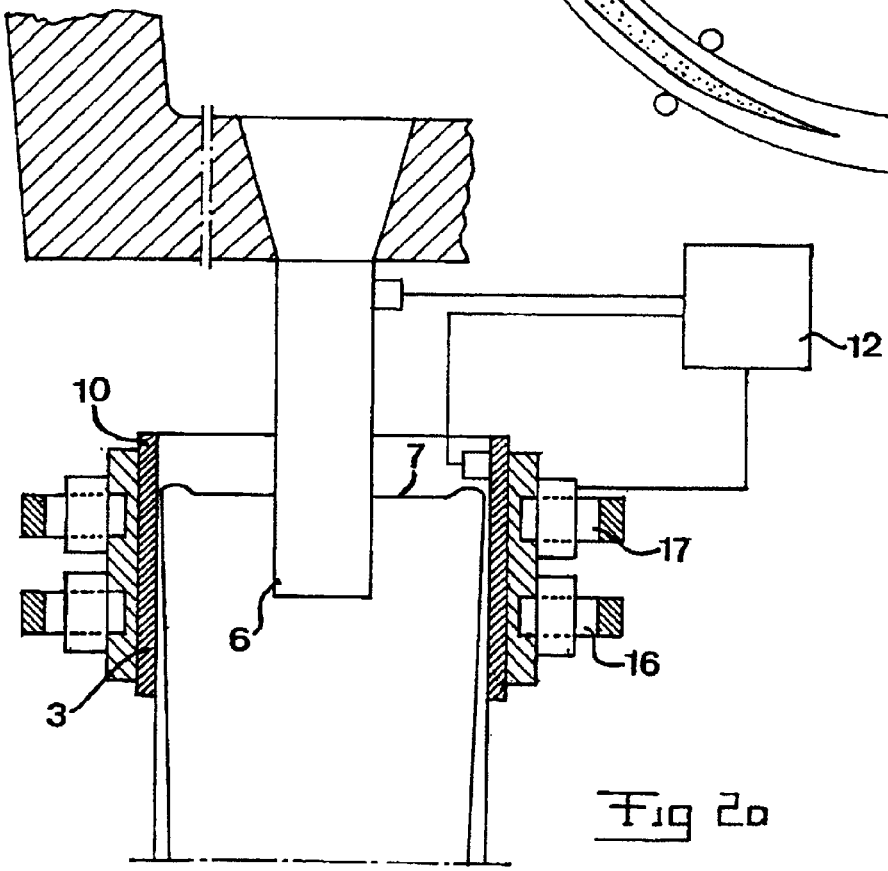
FIG. 2*a* is an enlarged cross-section view, in relation to FIG. 1, of an apparatus according to the invention for continuous casting of metals according to a first preferred embodiment of the invention.
Figure 2B:
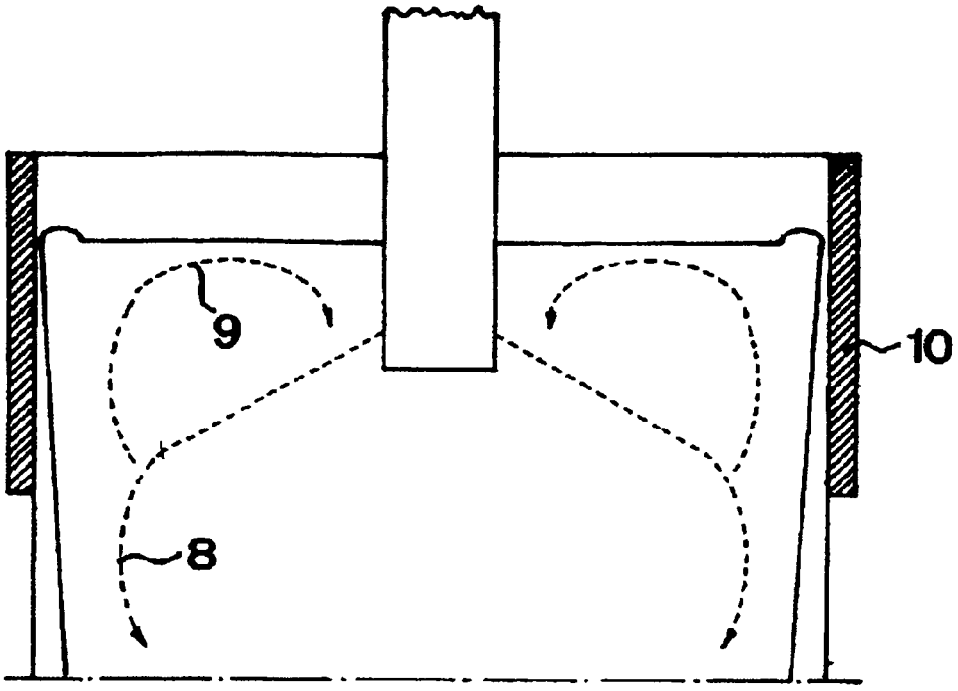
FIG. 2*b* is a simplified view of part of the apparatus according to FIG. 2*a* in the direction IIb—IIb in FIG. 3.
Figure 3:
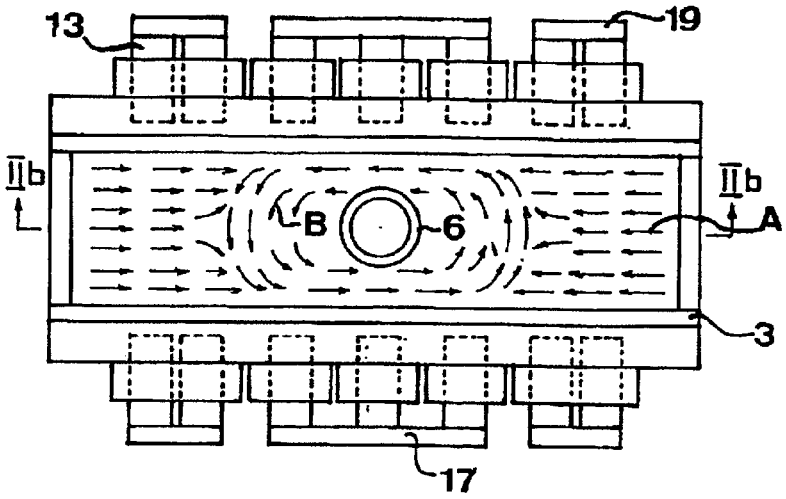
FIG. 3 is a schematic view from above of the apparatus according to FIG. 2.

The principles of the invention will now be described with reference to FIGS. 2–4, which in a simplified manner illustrate an apparatus for continuous casting of metals according to a first preferred embodiment of the invention. As previously stated, the casting mould 3 has an elongated horizontal cross section, and in practice this normally means a considerably smaller relation of length of the short side to length of the long side than what is shown in the figures, and in this respect the figures are only to be interpreted as explaining the principles of the invention. Thus, the thickness of the strand may, for example, be of the order of magnitude of 150 mm while at the same time its width is over 1,500 mm.

The molten metal that is supplied to the casting mould has a certain overtemperature, that is, the temperature thereof must be lowered to a certain extent in order for any part thereof to start solidifying. This is important in order to avoid that solidification of the molten metal begins too early, for example in the area of its upper surface. To avoid such solidification, it is also necessary that the melt should exhibit a certain movement in all regions, cross section-wise both centrally and at the ends, such that an equalization of the temperature of the upper surface may occur. In FIG. 3, it is shown how the melt typically flows in said secondary flow 9 in the upper surface. Likewise, it is important that the primary flow 8 downwards of the melt be essentially constant over the whole horizontal cross section of the casting mould, so that bubbles and the like formed therein have a possibility of moving upwards to the upper surface 7 and disappearing and are not drawn along in some part that moves considerably faster than any other part.

To bring about the desired movements of the melt in the casting mould under changing casting conditions, the apparatus exhibits magnetic members and a unit 12 adapted to control these members independently of each other in dependence on the value prevailing of one or more predetermined casting parameters. The magnetic members are schematically indicated electromagnets in the form of magnetic cores 13, preferably laminated iron cores, and electric conductor windings wound around these, which are schematically represented here. The unit 12 is adapted to control sources 15, 15', 15", connected to the different windings, for electrical energy to feed the windings with electric current and thereby generate magnetic fields extending from one long side to another in the casting mould through the melt.

The apparatus thus exhibits first magnetic members 16 adapted to generate a stationary magnetic field with a variable strength across essentially the whole horizontal cross section of the casting mould from one long side to the other long side in the vicinity of, or below, the region for supply of the molten metal to the casting mould. Thus, the unit 12 controls the source 15" to feed the windings of the magnetic member 16 with direct current of a variable strength to generate a magnetic field that exerts a braking effect on the movement of the melt downwards in the casting mould and the upwardly-directed flow at the short sides of the casting mould.

The apparatus also exhibits second magnetic members 17, also these being in the form of electromagnets, which are adapted to generate a variable magnetic field in the area of said upper surface in a region that is centrally located with respect to said cross section and close to said region for supply of melt. Along each long side of the casting mould, three coils are arranged, each being connected to a respective phase of a three-phase ac voltage. Further, the apparatus exhibits schematically indicated means 18 adapted to convert the ac voltage from the current source 15' to set the frequency thereof, whereby the converter may preferably vary the frequency down to 0 Hz such that a direct current is then fed to the coils of the second magnetic member 17. This means that, when generating a frequency exceeding 0 Hz of the current out from the converter 18, a magnetic field, travelling in the area of said upper surface in a direction towards the long sides of the casting mould, will be generated with a stirring and accelerating effect on the molten material in the central region of the upper surface. However, it is also possible to reduce the frequency to 0 Hz, thus generating a stationary magnetic field in this region, which then exerts a braking effect on movements in this central region.

In addition, the apparatus exhibits third magnetic members 19, which are also of the electromagnet type and adapted to generate a stationary magnetic field with a variable strength in the area of said upper surface in those end regions of the casting mould which, with respect to said cross section, are located externally of and remotely from the region for supply of the melt. In this way, where necessary, the movements of the melt in the area of the upper surface may be braked in these end regions, but it is also possible to disconnect this magnetic member when no such braking is desired.

Further, the apparatus exhibits members for measuring certain parameters that are important for the casting and sending information about this to the unit 12, so that this unit can then control the different magnetic members in dependence on this information. There is shown schematically a member 20 adapted to measure the temperature of the melt in the casting mould in an indirect manner by measuring the temperature of the wall of the casting mould. However, also direct measurement is possible. This temperature measurement may be performed continuously or intermittently at one or more points. It is then of special interest to measure the temperature in the area of the meniscus. Further, there is a member 21 for measuring the casting speed, that is, how large a volume of molten metal that is supplied to the casting mould per unit of time. It is also advantageous to arrange schematically indicated members 22 for measuring the level on the upper surface in the casting mould. The unit 12 preferably exhibits a processor capable of being influenced by a computer program for suitable control of the various magnetic members to achieve an optimum casting result.

At low casting speeds, it is important to stir the meniscus or the upper surface properly in the central region to maintain a stable, uniform temperature of the upper surface and then the second magnetic member 17 is preferably controlled to generate a travelling field with a relatively high strength to achieve such a stirring. In this context, the third magnetic members 19 could be almost or completely disconnected, whereas a certain degree of braking of the flows upwards and downwards in the molten metal through the first magnetic member 16 is desirable. In the upper surface this may result in the flow configuration according to FIG. 3 with a controlled or uncontrolled flow A and a stirred flow B.

At casting speeds in an intermediate range, the strength of the travelling field generated by the second magnetic member in the central region may be somewhat reduced, while at the same time the third magnetic members 19 are controlled to generate a stationary field that brakes the upper surface somewhat at the end regions.

At high casting speeds, powerful braking of the melt in the area of the upper surface is required to achieve an optimum speed of the movements of melt in this area, normally 0.3+−0.1 m/sec. Also the second magnetic member 17 is advantageously controlled to generate a stationary, braking magnetic field in the central region of the upper surface, but the magnetic members 19 are controlled such that the braking effect is greater at the end regions to achieve a uniform speed of the molten material along the whole upper surface. At such high casting speeds, also a control of the first magnetic member 16 is required to brake relatively powerfully.

Figure 4:
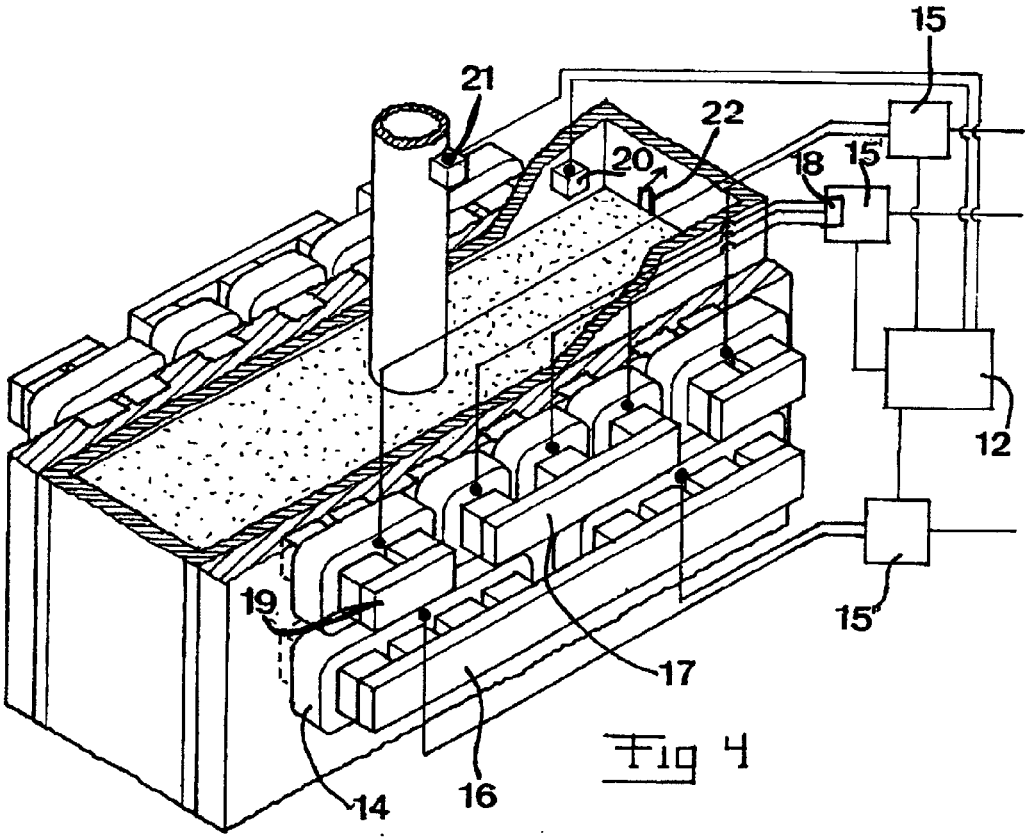
FIG. 4 is a partially cut-away perspective view of the apparatus according to FIG. 2.

The combination of the three magnetic members of the apparatus according to FIG. 4 and the possibility of separate control thereof provided by the unit 12 contribute to achieve a flow rate of the melt in various parts of the casting mould which is optimal for the casting result, and to achieve a uniform, stable temperature of the upper surface of the melt at low and high casting speeds as well as casting speeds in the intermediate range.

Figures 5, 6, 7:
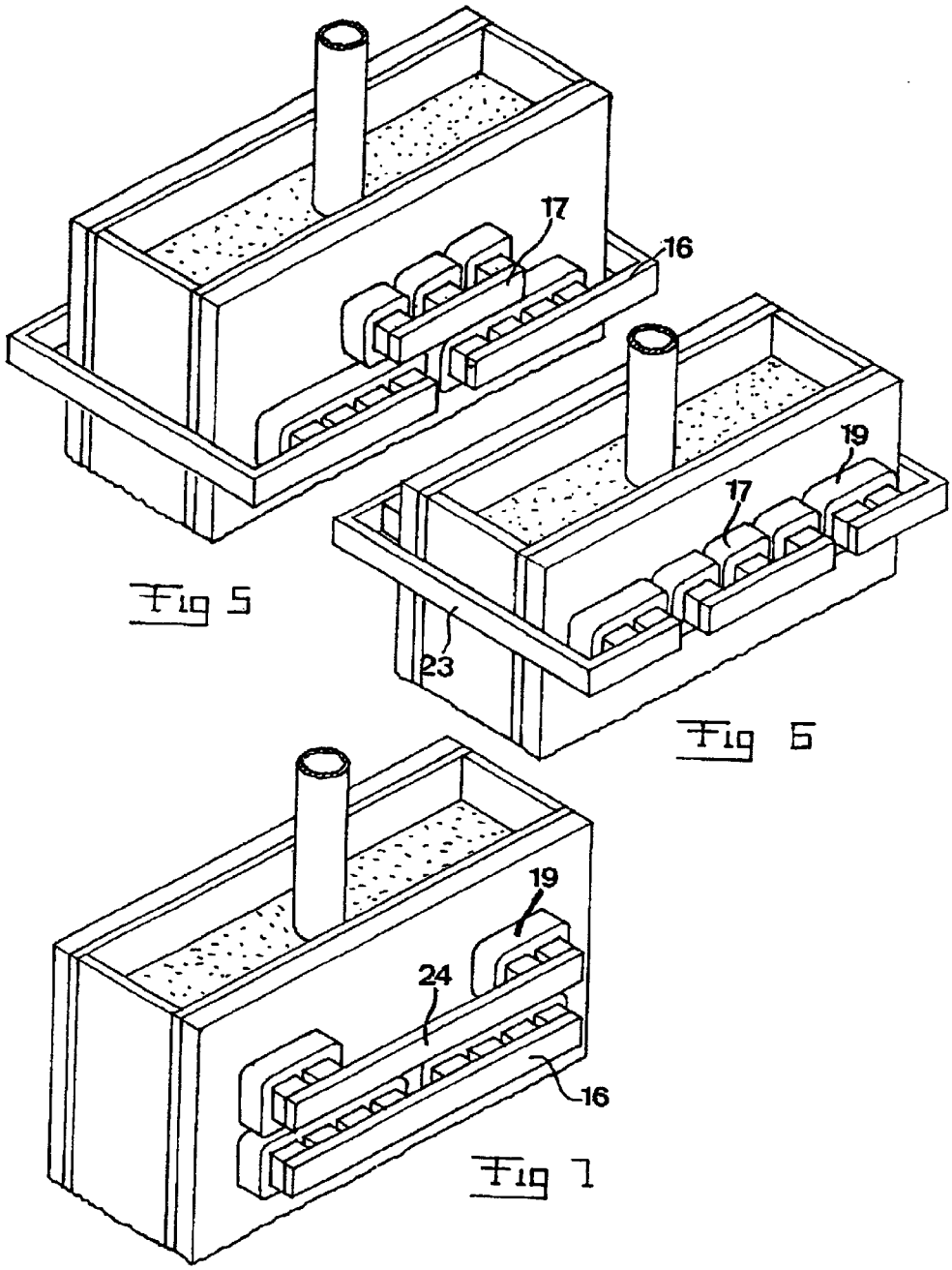
FIG. 5 is a simplified perspective view of part of the apparatus according to a second preferred embodiment of the invention.
FIG. 6 is a view, corresponding to FIG. 5, of an apparatus according to a third preferred embodiment of the invention.
FIG. 7 is a view, corresponding to FIG. 5, of an apparatus according to a fourth preferred embodiment of the invention.

FIG. 5 illustrates schematically how an apparatus according to the invention could be provided with only first 16 and second 17 magnetic members, which makes this apparatus suited especially for lower casting speeds. It is pointed out that in this embodiment and the embodiments according to FIGS. 6 and 7, electromagnets are arranged along both long sides of the casting mould and these are supplied and controlled in a manner corresponding to that shown for the embodiment according to FIG. 4, although this is not shown in these figures for reasons of simplification.

FIG. 6 illustrates an apparatus according to an embodiment that only exhibits said second 17 and third 19 magnetic members. Here, it is illustrated how the magnetic field generated by the third magnetic member 19 in an end region is closed by a yoke 23 interconnecting the electrodes, whereas another possibility is illustrated in FIG. 7. There, the two electromagnets, belonging to the magnetic member 19 and arranged on the same long side, are arranged with their poles in such a way that the magnetic field is closed by a yoke 24 interconnecting these. The embodiment shown in FIG. 7 with only first and third magnetic members 16 and 19, respectively, constitutes a simplified variant of the apparatus according to the invention, especially suited for higher casting speeds.

The invention is not, of course, in any way limited to the embodiments described above, but a plurality of possibilities of modifications thereof should be obvious to a person skilled in the art, without deviating from the basic concept of the invention.

For example, the various magnetic members could have a different extent in the cross section of the casting mould to that shown in the figures, and, for example, in the embodiment according to FIG. 5, the second magnetic member could extend a longer distance along the respective long side, possibly to the respective short side, depending on the casting process that is to be controlled.

In the second magnetic member, the number of phases could be different from three, for example two.

The different magnetic fluxes could be closed in largely arbitrary ways. For example, the magnetic flux from the magnetic members at the end regions of the upper surface could be closed via the first magnetic members located at a deeper level.

It would also be possible to refine the control possibilities such that each individual coil (electromagnet) is controlled separately from the other coils.

What is claimed is:

1. An apparatus for continuous casting of metals, comprising:

a casting mold with an elongated horizontal cross section, through which a molten metal is intended to pass during the casting process, a member for supplying a molten metal to such molten metal already present in the casting mold in a region at a distance below the upper surface of the latter melt, and a device adapted to apply magnetic fields to the melt in the casting mold to exert an influence on movements of the molten metal, wherein the device exhibits members adapted to generate a stationary magnetic field with a variable strength across essentially the whole of said cross section of the casting mold from one long side to the other long side in the vicinity of, or below, the region for said supply of the molten metal, members adapted to generate a variable magnetic field in the area of said upper surface in a region that is centrally located with respect to said cross section and close to said region for supply of melt, measuring members operative to measure casting parameters, and wherein the apparatus comprises a unit adapted to control the magnetic members of the device to generate, independently of each other, magnetic fields with an appearance that is dependent on the value prevailing of one or more predetermined casting parameters, wherein said magnetic members comprise magnetic cores and electric conductor windings passed around these, wherein the apparatus comprises one or more sources for supplying electric current to these windings, and wherein said unit is adapted to control the supply of current to the windings in dependence on the value prevailing of one or more predetermined casting parameters.

2. The apparatus according to claim 1, further comprising:

outer magnetic members adapted to generate a stationary magnetic field with a variable strength in the area of said upper surface in the end regions of the casting mold which, with respect to said cross section, are located externally of and remotely from the above-mentioned region for supply of the melt, that the apparatus comprises a unit adapted to control said outer magnetic members to generate a magnetic field with a strength that is dependent on the value prevailing of one or more predetermined casting parameters, and wherein, also, said magnetic members for generating a magnetic field in said end regions comprise magnetic cores and electric conductor windings passed around these, and wherein said sources are arranged to feed electric current to said windings, and wherein said unit is adapted to control the supply of current to the windings in dependence on the value prevailing of one or more predetermined casting parameters.

3. The apparatus according to claim 1, wherein said magnetic member for generating a magnetic field in said central region of the upper surface extends over essentially the whole of said cross section of the casting mold from one short side to the other short side for generating magnetic fields in the area of the upper surface over essentially the whole of the horizontal cross section.

4. The apparatus according to claim 1, wherein said magnetic member for generating a magnetic field in said central region comprises at least two magnetic cores arranged along each long side of the casting mold with electric conductor windings connected to different phases of a source for generating a polyphase ac voltage for achieving a magnetic field that travels in said central region in the upper surface of the melt in the direction of the long side of the casting mold.

5. The apparatus according to claim 4, wherein said magnetic member for generating a magnetic field in said central region of the casting mold comprises at least three magnetic cores with electric conductor windings and are adapted to be connected to a three-phase ac voltage.

6. The apparatus according to claim 4, further comprising:

means for varying the frequency of the current through the windings of the magnetic member for generating the magnetic field in said central region of the casting mold, wherein the unit is adapted to control said means in dependence on the value prevailing of one or more predetermined casting parameters.

7. The apparatus according to claim 6, wherein said means has the ability to control said frequency down to 0 Hz, such that a direct current is fed through said windings and a stationary magnetic field is generated in the area of the upper surface in said central region of the casting mold.

8. The apparatus according to claim 6, wherein said means is formed from a dc/ac or an ac/ac converter.

9. The apparatus according to claim 1, wherein the measuring members comprise members adapted to measure the temperature of the melt in the casting mold near said upper surface and to send information about this to the unit as a said predetermined casting parameter.

10. The apparatus according to claim 9, wherein the temperature-measuring member is adapted to measure the temperature of the melt indirectly by sensing the temperature of a wall of the casting mold.

11. The apparatus according to claim 1, wherein the measuring members comprise members adapted to measure the casting speed, that is, how large a volume of melt that is supplied to the casting mold per unit of time, and to send information about this to the unit as a said predetermined casting parameter.

12. The apparatus according to claim 1, wherein the measuring members comprise members adapted to measure the level of said upper surface of the melt in the casting mold and to send information about this to the unit as a said predetermined casting parameter.

13. The apparatus according to claim 1, wherein the unit is adapted to control one or more of said magnetic members occasionally not to generate any magnetic field.

14. The apparatus according to claim 11, wherein the unit is adapted, under otherwise equal conditions, to increase the strength of the magnetic field generated by the magnetic members in the vicinity of, or below, the region for supply of the molten metal at increased casting speed and inversely at decreased casting speed.

15. The apparatus according to claim 2, wherein the unit is adapted to control said member for generating a stationary magnetic field in said upper surface in said end regions of the casting mold to increase the strength of the magnetic field at increased casting speed and inversely at decreased casting speed.

16. The apparatus according to claim 15, wherein the unit is adapted to control said magnetic member for generating a magnetic field in said end regions not to generate any magnetic field at a casting speed lower than a threshold value.

17. The apparatus according to claim 6, wherein the unit is adapted, at specified values of one or more of said predetermined casting parameters, to control said member for generating a magnetic field in the area of the upper surface in said central regions to alternately generate a so-called alternating field, changing in time, for stirring the molten metal and a stationary magnetic field for braking the movements of the molten metal.

18. The apparatus according to claim 7, wherein the unit is adapted to control said member for generating a magnetic field in the area of the upper surface in said central regions to generate a stationary magnetic field at a casting speed exceeding a predetermined threshold value.

19. The apparatus according to claim 1, wherein the unit is adapted to control said magnetic members in dependence on the value prevailing of one or more predetermined casting parameters according to an algorithm for the purpose of achieving a flow rate of the melt in various parts of the casting mold that is optimal for the casting result, and a uniform, stable temperature of the upper surface of the melt.

20. The apparatus according to claim 1, wherein said supply members are adapted to supply the molten metal in the form of a jet to a region of the casting mold that is located essentially centrally with respect to said cross section.

21. A method for continuous casting of metals, wherein a molten metal is supplied to a casting mold with an elongated horizontal cross section to such molten metal already present in the casting mold in a region at a distance below the upper surface of the latter melt, whereby at least one magnetic field is applied to the melt in the casting mold to exert an influence on the movement of the molten metal, wherein a stationary magnetic field with a variable strength is generated across essentially the whole of said cross section of the casting mold from one long side to the other long side in the vicinity of, or below, the region for said supply of the molten metal, wherein a variable magnetic field is generated in the area of said upper surface in a region that is centrally located with respect to said cross section and close to said region for supply of melt, and wherein said two magnetic fields are generated independently of each other and such that each of them will have an appearance that is dependent on the value prevailing of one or more predetermined casting parameters, wherein said magnetic fields are generated by sending electric current through electric conductor windings that surround magnetic cores, and wherein the supply of current to said windings is made dependent on the value prevailing of one or more predetermined casting parameters for control of said magnetic fields.

22. The method according to claim 21, wherein, in addition, a stationary magnetic field with a variable strength is generated in the area of said upper surface in the end regions of the casting mold which, with respect to said cross section, are located externally of and remotely from the above-mentioned region for supply of the melt, wherein the strength of the magnetic field is controlled in dependence on the value prevailing of one or more predetermined casting parameters, and wherein, also, said stationary magnetic field with a variable strength in said end regions is generated by sending electric current through electric conductor windings that surround magnetic cores, and wherein the supply of current to said windings is made dependent on the value prevailing of one or more predetermined casting parameters for control of said magnetic field.

23. The method according to claim 21, wherein said magnetic field in the central region is generated in the form of a magnetic field that travels in said central region in the area of the upper surface of the melt in the direction of the long side of the casting mold by supplying, in a polyphase ac voltage, different phases to said windings arranged one after the other along the long side of the casting mold in a horizontal direction, for stirring the molten material in said central region.

24. The method according to claim 23, wherein the frequency of the current through the windings that generate the magnetic field in said central region of the casting mold is controlled in dependence on the value prevailing of one or more predetermined casting parameters.

25. The method according to claim 21, wherein the temperature of the melt in the casting mold close to said upper surface is measured during the casting process and used as a said predetermined casting parameter for controlling said magnetic fields.

26. The method according to claim 21, wherein the casting speed, that is, how large a volume of melt that is supplied to the casting mold per unit of time, is measured during the casting process and said magnetic fields are controlled in dependence on the magnitude of this casting speed.

27. The method according to claim 21, wherein the level of said upper surface of the melt in the casting mold is measured during the casting process and said magnetic fields are controlled in dependence on this measured level.

28. The method according to claim 26, wherein, under otherwise equal conditions, the strength of the magnetic field in the vicinity of, or below, the region for supply of the molten metal is increased at increased casting speed and inversely at decreased casting speed.

29. The method according to claim 22, wherein the strength of said stationary magnetic field in the area of the upper surface in said end regions of the casting mold is increased at increased casting speed and inversely at decreased casting speed.

30. The method according to claim 29, wherein, at a casting speed that is lower than a threshold value, a zero magnetic field, that is, no magnetic field, is generated in said end regions of the casting mold.

31. The method according to claim 24, wherein, at definite values of one or more of said predetermined casting parameters, there are alternately generated, in the area of the upper surface in said central region, a so-called alternating field, changing in time, for stirring the molten metal in this region and a stationary magnetic field for braking the movements of the molten metal in this region.

32. The method according to claim 24, wherein, in the area of the upper surface in said central region, a stationary magnetic field is generated at a casting speed exceeding a predetermined threshold value.

33. The method according to claim 23, wherein at casting speeds, which in this connection are low, below a threshold value for the casting speed, an alternating magnetic field is generated in the area of the upper surface in said central region for stirring the molten metal in this region.

34. The method according to claim 22, wherein at casting speeds in an intermediate range below a lower and an upper threshold value, there are generated an alternating magnetic field in the area of the upper surface in said central region for stirring the molten metal in this region, and a stationary magnetic field in the area of the upper surface in said end regions for braking the movements of the molten metal there.

35. The method according to claim 22, wherein at high casting speeds above an upper threshold value, when there is a need of powerful braking of movements of the molten material in the area of said upper surface, there are generated a stationary magnetic field in the area of the upper surface in said central region for braking the movements of the molten metal there, and a stationary magnetic field in the area of the upper surface in said end regions for braking the movements of the molten metal there.

36. The method according to claim 21, wherein said magnetic fields are controlled in dependence on the value prevailing of one or more predetermined casting parameters according to an algorithm for the purpose of achieving a flow rate of the melt in various parts of the casting mold that is optimal for the casting result, and a uniform, stable temperature of the upper surface of the melt.

37. The method according to claim 21, wherein the molten metal is supplied to the casting mold in the form of a jet in a region of the casting mold that is essentially centrally located with respect to said cross-section.

* * * * *